United States Patent [19]

Foust

[11] 4,126,906

[45] Nov. 28, 1978

[54] WATERBED FRAME CONNECTOR

[76] Inventor: Doug L. Foust, 847 Rose Ave. #13, Pleasanton, Calif. 94566

[21] Appl. No.: 854,358

[22] Filed: Nov. 23, 1977

[51] Int. Cl.[2] ..... A47C 27/08

[52] U.S. Cl. ..... 5/295; 5/201; 5/288; 312/263

[58] Field of Search ..... 5/200 R, 202–282 R, 5/288, 294–297, 299, 317, 370, 371; 312/263

[56] References Cited

U.S. PATENT DOCUMENTS

| | | | |
|---|---|---|---|
| 1,791,750 | 2/1931 | Bowers | 5/294 |
| 3,501,786 | 3/1970 | Hurwitz | 5/201 |
| 3,702,137 | 11/1972 | Evans | 5/288 |
| 3,822,423 | 7/1974 | Walts | 5/201 |
| 3,999,236 | 12/1976 | Macaulley | 5/370 |

*Primary Examiner*—Casmir A. Nunberg
*Attorney, Agent, or Firm*—James R. Cypher

[57] ABSTRACT

A connector means for lockably releasably connecting the rigid side frame members containing the flexible container for a waterbed each connector means including a keeper member having openings for receiving the projecting members of a latch member. A locking member mechanically connects the latch member to the keeper member.

2 Claims, 11 Drawing Figures

WATERBED FRAME CONNECTOR

BACKGROUND OF THE INVENTION

Since the introduction of the waterbed by Hall, U.S. Pat. No. 3,585,356 granted June 15, 1971 and others, the bed industry has experience a revolutionary change. Hall taught that a flexible plastic bag containing several hundred pounds of water must be rigidly supported on all sides. Although there are some circular waterbeds, most are constructed in a rectangular form with the sides formed from 2 × 10 wood members. Because of the greatly increased weight of the water, the conventional bedpost supported rail system can no longer be used. Almost all waterbeds are supported by a pedestal which evenly distributes the weight of the bed over a large area of the supporting floor.

Prior to the introduction of the present frame connector, the rigid side members were connected by L-shaped angle members or conventional standard door hinges which were attached to the adjoining frame members by wood screws. While the simple angle member is relatively inexpensive, separate attachment means were necessary to attach the cosmetic corner member which generally is made from a different type wood or contains decorative carvings to give the bed an attractive appearance and cover the end grain of the frame members. The need for separately connecting the cosmetic corner results in a relatively costly manufacturing procedure. The present connector is substantially less expensive than the conventional door hinges.

The screw fastener attached frame members rendered the waterbed relatively difficult to take apart and reassemble. Since many waterbeds are purchased by young singles and young marrieds who move their residences relatively frequently and find it necessary to disassemble and reassemble their waterbeds, the conventional angle connected waterbed frames proved to be an unsatisfactory connection means. Repeated insertion of fasteners, as many as 24 screws, results in weakening the frame connection.

Some waterbed manufacturers have recognized the problems of disassembling and reassembling waterbeds and have replaced the screw fastener attached angle members with the more traditional connectors consisting of a plate with slots therein for receiving hooks from an adjacent connector member. While permitting ease of construction and reassembly, these connectors have proven unsatisfactory since they permit relative movement between adjoining side frame members. This relative movement at best causes an annoying squeaking of the bed and at worst results in pinching the plastic water container and sometimes results in a rupturing of the bag and loss of water. With a bag containing a few hundred gallons of water, the water damage to carpets, floors and ceilings to the apartment below can be considerable.

If the hook means comes out of the slot, the water container tends to extrude through the opening. A tear usually results and the water is released.

Glaser, et al, U.S. Pat. No. 3,879,774 recognized the problem of holding the frame members tightly together and connected the adjacent frame members together by turnbuckles.

SUMMARY OF THE INVENTION

The gist of the present invention is the provision of a means for locking the keeper and latch members together so that the adjoining frame members of the waterbed cannot move relative to one another and the frame members cannot be accidentally parted.

In its simplest form, the lock means may be a bendable member which can be moved into and out of locking position by a common screw driver.

An objective of the present invention is to provide a frame connector which will permit waterbed frames to be constructed more economically.

Another object is to enable waterbed frames to be assembled more quickly at the factory and permit the frames to be assembled and disassembled more quickly be retailers, installers, furniture movers and by the owners themselves.

DESCRIPTION OF THE INVENTION

Figure 1:
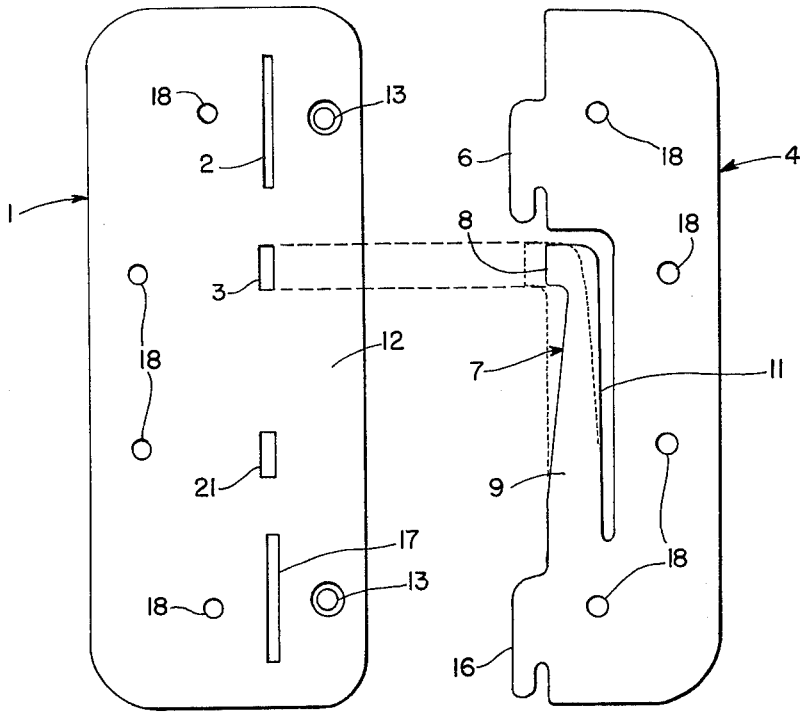
FIG. 1 is a side elevation view of the connector means of the present invention. The dashed lines indicate the positioning of the locking means. The dotted lines indicate the position of the locking means in the locked position.

The bed frame connector of the present invention consists of a keeper member 1 formed with a hook opening 2 and a lock opening 3; a latch member 4 formed with a hook member 6 and a lock means 7 connecting the keeper and the latch members.

Preferably the lock means is an integral part of the latch member and includes a catch member 8 for registration and attachment to the lock opening 3 in the keeper member.

As illustrated in the drawings, the lock means includes an elongated member 9 connected to the catch member. The latch member is formed with an opening 11 adjacent the elongated member which is adapted for receipt of a bending instrument such as a screw driver.

A feature of the present invention is the fact that the keeper member includes an extension portion 12 formed with fastener openings 13 adapted for attachment of a cosmetic corner 14. The cosmetic corner is usually made from a type of wood different from the frame members or is especially carved or veneered for decorative purposes.

Figure 2:
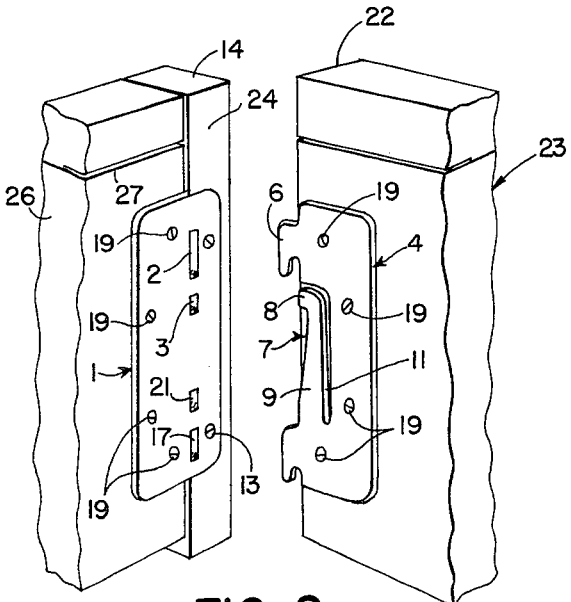
FIG. 2 is a perspective view of the connector shown in FIG. 1 but on a reduced scale. Portions of a typical waterbed frame are shown in a separated position.
Figure 3:
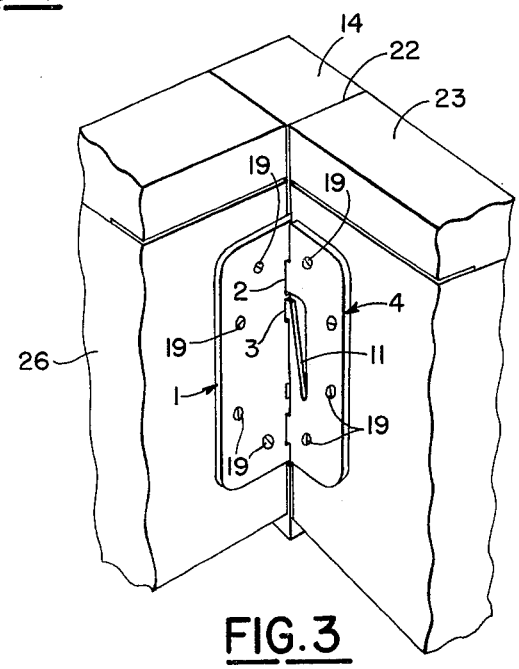
FIG. 3 is a perspective view of the connector shown in FIG. 2, but in the locked position.

As shown in FIGS. 1–3, the latch member is preferably formed with a second hook member 16 which is received in opening 17 of the keeper member. Both the keeper member and the latch members are formed with openings 18 for the receipt of screw fasteners 19. As an added feature, the keeper member may be formed with an additional lock opening 21 so that the keeper may be installed on either frame member at each intersection eliminating the need for "lefts" and "rights."

As shown in FIGS. 2 and 3, the cosmetic corner member is routed out so that end 22 of the frame member 23 may abut side 24 of the cosmetic member. Note also that the frame member 26 may be formed with a thin dado slot 27 which extends approximately ¾ inch deep for receipt of the safety liner.

Both the keeper and latch members may be constructed from flat metal stock.

The lock means elongated member as shown in FIGS. 1–3 is formed integrally with the flat metal stock latch member by cutting out an L-shaped slot 11 in the member. This slot is wide enough so that an end of a screw driver may be inserted in the slot. By twisting the screw driver, the member 9 is bent so as to assume the position of the dotted lines in FIG. 1. The elongated member is formed in an inverted L-shaped so that the catch member 8 registers with lock opening 3 or lock opening 21 in the inverted position of the keeper member. Thus with the catch member 8 inserted in the lock opening, no relative vertical movement can take place between adjoining frame members 23 and 26. The locked position is shown in FIG. 3.

Figure 8:
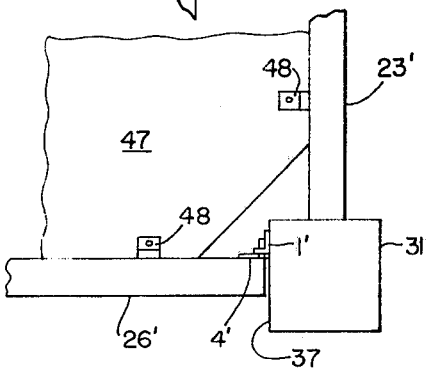
FIG. 8 is a top plan view of one corner of the waterbed shown in FIG. 6 taken generally along the lines 8—8.

Another form of the invention is shown in FIGS. 4, 5, 6 and 8. The connector illustrated in this form is used for the "four-poster" style bed and bench beds where the cosmetic corner is not employed such as butt, rabbet, mitered and dado junctions. As shown in FIG. 8, frame member 23' is attached to vertical post member 31 by any standard means. Frame member 23' may also be attached to post 31 by means of the connector illustrated in FIG. 4. Frame member 26', however, is attached to the post by means of the connector shown in FIG. 4. The connector consists of a keeper member 1' formed with a hook opening 2' and a lock opening 3'; a latch member 4' formed with a hook member 6'; and lock means 7' connecting the keeper and latch member. The portions 32 and 33 of the keeper member carrying the hook openings are positioned at an angle of substantially 90° in relation to the other portion of the keeper member. The hook member 6' on the latch member is positioned at approximately a 90° angle thereto. Preferably each keeper member is formed with a second hook opening 17' and a second lock opening 21'. The latch member is also formed with a second hook member 16'. The keeper member and the latch member are formed with openings 18' for the receipt of fasteners such as screws 19'.

The lock means 7' includes an elongated inverted "L-shaped" member having a relatively straight portion 9' with a short catch member 8'.

In order to prevent the lock means from separating from the keeper member, the openings 3' and 21' which are an open slot are formed so that the slot is narrower at the opening A than at inner edges 34 and 35. The end 8' of the lock member is dimensioned to register with the wide opening of the slot and to have an edge length 36 greater than the width of the slot at its edge to prevent accidental horizontal movement and unlocking. The shape of the opening is immaterial and may be a portion of a circle so long as the slot opening "A" is smaller than the edge length 36.

Operation of the form of the invention is the same as previously described. Keeper 1' is attached to side 37 of the post 31. Latch member 4' is attached to frame member 26'. To assemble the frame, hooks 6' and 16' are inserted through hook openings 2' and 17' so that the edges 38 and 39 rest on ledges 41 and 42 of the hook openings. The ends 43 and 44 of the hooks protrude below the openings. After the frame member has been attached to the post, an object such as a screw driver is placed into the "L-shaped" slot 11', twisted, and the elongated member 9' is moved towards the keeper member so that the end 8' of the elongated member registers with either lock opening 3' or 21'.

Figure 10:
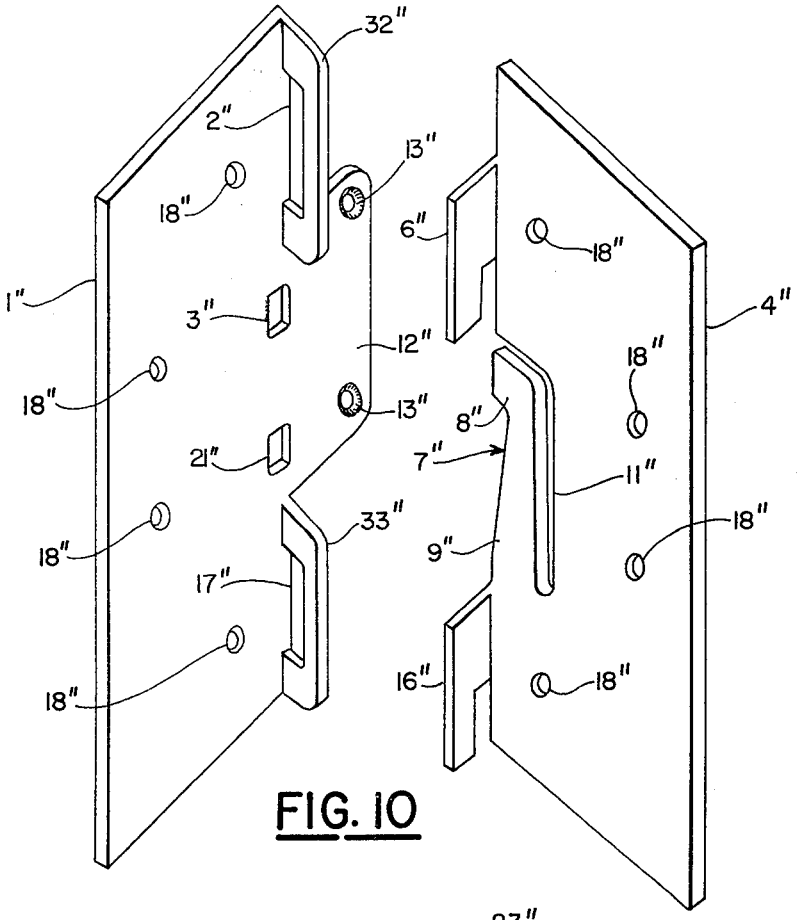
FIG. 10 is a perspective view of another alternate form of the present invention.
Figure 9:
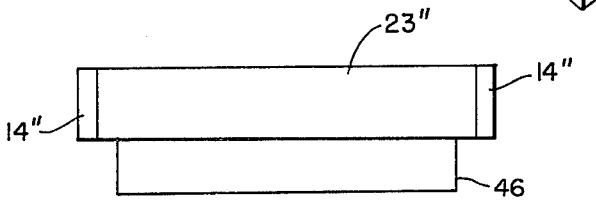
FIG. 9 is an end view of a bench type bed.
Figure 11:
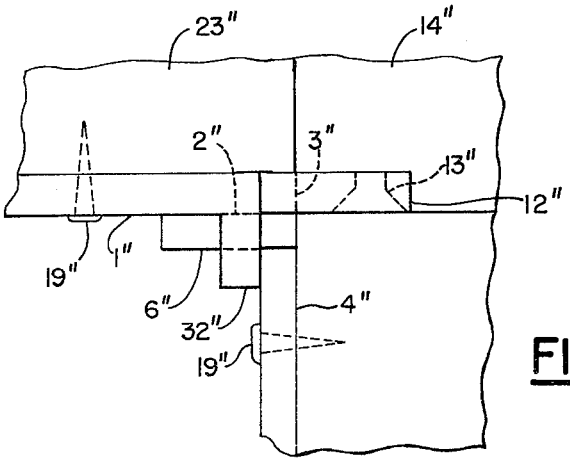
FIG. 11 is a top plan view of the connector shown in FIG. 10.

Still another form of the connector of the present invention is illustrated in FIGS. 10 and 11. This form of the invention is used in the pedestal type bed as illustrated in FIG. 9 having frame members 23" with cosmetic corners 14" supported by a pedestal 46. In this form of the invention, the keeper member is formed with hook openings 2" and 17" and at least one lock opening 3" and preferably a second lock opening 21". The members 32" and 33" forming the hook openings are bent at a 90° angle to the rest of the member. Openings 18" for fasteners are formed in the keeper member. An extension 12" is formed flush with the keeper member and is formed with openings 13" which receive fasteners for attaching the cosmetic corner.

Figure 4:
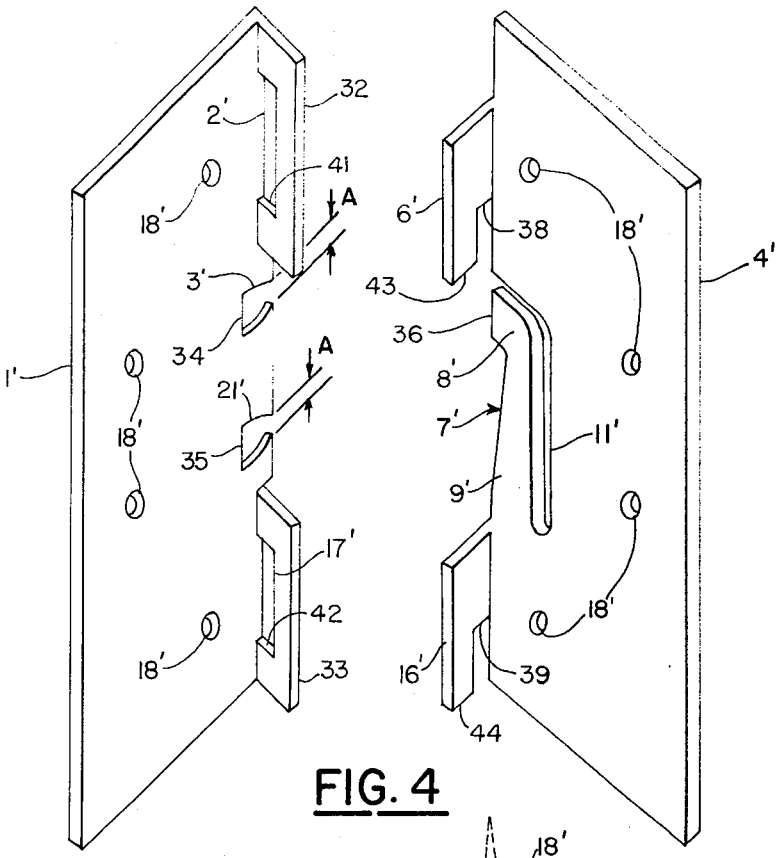
FIG. 4 is a perspective view of an alternate form of the present invention.
Figure 5:
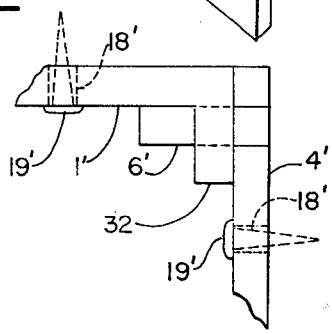
FIG. 5 is a top plan view of the connector shown in FIG. 4.
Figure 6:
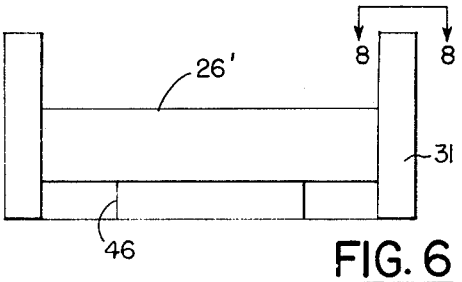
FIG. 6 is a side elevation view of a waterbed constructed with corner posts which are particularly suitable for use with the connectors shown in FIG. 4.

The latch member 4" is formed identical to the latch member illustrated in FIG. 4 and consists of hook members 6" and 16" and lock member 7" consisting of an inverted "L-shaped" member having an elongated member 9" and a catch member 8".

The assembly of the connector illustrated in FIG. 10 is similar to the connector shown in FIG. 1. The keeper member 1" is attached to a frame member such as 23" by fasteners 19" in openings 18". A cosmetic corner 14" is then attached to the keeper member by screws through openings 13". The latch member 4" is then connected to a frame member through openings 18". The connectors are attached by placing hooks 6" and 16" through hook openings 2" and 17". The lock member 7" is then bent by placing a tool in slot 11" so that catch member 8" registers with either lock opening 3" or 21".

Figure 7:
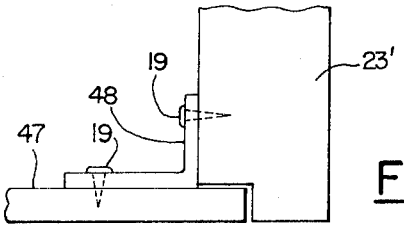
FIG. 7 shows a typical means for connecting the plywood deck member to a frame member. Portions only of the frame and decking are illustrated.

FIG. 7 illustrates a standard method of attaching a plywood base member 47 to a frame member such as a 2×10 23'. A simple angle member 48 fastened by screws 19 is commonly employed.

I claim:

1. A bed frame connector comprising:

a. a keeper member formed with a hook opening and a lock opening;

b. a latch member formed with a hook member;

c. lock means connecting said keeper and latch members;

d. a portion of said keeper member carrying said hook opening is positioned at an angle of substantially 90° in relation to the other portion of said keeper member;

e. said opening in said keeper member is an open slot formed in the edge of said keeper member and said slot is narrower at its opening; and f. said end of said lock member is dimensioned to register with the wide opening of said slot and to have an edge length greater than the width of said slot at its edge to prevent accidental horizontal movement and unlocking.

2. A bed frame connector comprising:

a. a keeper member formed with a hook opening and a lock opening;

b. a latch member formed with a hook member;

c. lock means connecting said keeper and latch members;

d. a portion of said keeper member carrying said hook opening is positioned at an angle of substantially 90° in relation to the other portion of said keeper member; and e. said keeper member includes an extension member formed with fastener openings adapted for attachment of a cosmetic corner thereto.

* * * * *